US010076680B2

(12) United States Patent
Hillson

(10) Patent No.: US 10,076,680 B2
(45) Date of Patent: Sep. 18, 2018

(54) EXERCISE APPARATUS INCLUDING AN ADJUSTABLE SUPPORT PLATFORM

(71) Applicant: Escape Fitness Limited, Peterborough (GB)

(72) Inventor: Nicholas Hillson, Peterborough (GB)

(73) Assignee: Escape Fitness Limited, Peterborough (GB)

( * ) Notice: Subject to any disclaimer, the term of this patent is extended or adjusted under 35 U.S.C. 154(b) by 0 days.

(21) Appl. No.: 15/265,682

(22) Filed: Sep. 14, 2016

(65) Prior Publication Data

US 2017/0080284 A1 Mar. 23, 2017

(30) Foreign Application Priority Data

Sep. 22, 2015 (GB) ..... 1516776.0

(51) Int. Cl.

*A63B 22/00* (2006.01)
*A63B 23/04* (2006.01)
*A63B 21/00* (2006.01)

(52) U.S. Cl.

CPC .... *A63B 23/0458* (2013.01); *A63B 21/00047* (2013.01); *A63B 21/4033* (2015.10); *A63B 21/4029* (2015.10); *A63B 2225/09* (2013.01); *A63B 2225/093* (2013.01)

(58) Field of Classification Search

CPC ..... A63B 2225/093; A63B 23/0458
See application file for complete search history.

(56) References Cited

U.S. PATENT DOCUMENTS 5,127,647 A * 7/1992 Wilkinson ..... A63B 23/0458 108/12
7,651,452 B2 1/2010 Weir et al.

* cited by examiner

*Primary Examiner* — Loan H Thanh
*Assistant Examiner* — Rae Fischer
(74) *Attorney, Agent, or Firm* — Maine Cernota & Rardin

(57) ABSTRACT

An exercise apparatus having a platform for supporting a person during exercise, a first support arranged to support a first end of the platform at an elevated position, and a second support arranged to engage with the platform at a second end to support the second end of the platform at an elevated position, at least the second support being removable to vary the height of the second end, wherein the first support includes a pivotal engagement element configured for engagement with at least one corresponding pivotal engagement element of the platform such that in use when said pivotal engagement element of the platform is engaged with and supported by the pivotal engagement element of the first support the platform is able to pivot relative to the first support to vary the inclination of the platform when the height of the second end relative to the first end is varied.

15 Claims, 6 Drawing Sheets

EXERCISE APPARATUS INCLUDING AN ADJUSTABLE SUPPORT PLATFORM

CROSS REFERENCE TO RELATED APPLICATIONS

This application claims the benefit of UK Patent Application No. 1516776.0, filed 22 Sep. 2015, the entire contents and substance of which is hereby incorporated by reference.

BACKGROUND OF THE INVENTION

1. Field of the Invention

The present invention relates to an exercise apparatus including an adjustable support platform, and in particular an exercise step having a platform that is able to be reconfigured between horizontal and sloped orientations.

2. Description of Related Art

It is well established that steps may be used for physical training and rehabilitation exercises, and the use of a stair risers or box steps for muscle strengthening has long been prescribed by doctors and physiotherapists during injury recovery. More recently, organized step aerobics classes have become an increasingly popular form of exercise, particularly for group training. Step training involves each participant being provided with an elevated support platform which is used to perform aerobic exercise by stepping or jumping onto the platform. Exercise steps are typically height adjustable to enable them to be tailored for persons of varying height and to varying the height for varying types of exercise.

It is known to vary the height of an exercise step using stacked 'risers' that support the platform in a horizontal orientation. By adding or removing risers from that stack at each end of the step the height may be adjusted. It is also known, for example from WO2004016325, to provide exercise steps with legs that are adjustable in height. In each instance, the legs or risers must be arranged at equal heights either end of the platform to ensure stability. As the platform is used to support the full body weight of a user in motion, instability of the platform could result in injury to user.

Step exercises typically comprise the user stepping with one foot from the ground onto the level platform which activates a specific limited set of muscles. It has been identified that further benefits may be achieved from step training if the platform is angled relative to the ground either lengthwise or width wise. This is not possible with conventional step platforms. For example, if one were to provide a platform with stacks of different heights at each end, the platform would be inclined but would no longer seat along the upper surface of either riser stack and would instead be provided only with edge contacts. The platform would slip from the risers once any weight were applied. This has been addressed by providing wedge shaped slanted risers that are provided at the top of each stack, or more normally with a single wedge at one end and a second wedge supported on a stack of horizontal risers at the other. The wedges provide a sloped surface that supports the platform more securely. However, the angle of the platform is fixed by the angle of the wedged risers. More problematically, this solution requires wedged risers as an additional component that are only required and usable for sloped platform exercises, and must be removed and stowed when not required, as well as requiring additional storage and transit volume. The requirement to swap in wedged risers is also cumbersome, and the need for these additional components adds cost.

There is therefore a need for an exercise step that may be securely used in both a horizontal and angled configuration, which addresses the above described problems and/or which offers improvements generally.

According to the present invention there is provided an exercise apparatus as defined in the accompanying claims.

BRIEF SUMMARY OF THE INVENTION

In an embodiment of the invention there is provided an exercise apparatus comprising a platform for supporting a person during exercise; a first support arranged to support a first end of the platform at an elevated position; and a second support arranged to engage with the platform at a second end to support the second end of the platform at an elevated position and movable to vary the height of the second end. The first support includes a pivotal engagement element configured for engagement with at least one corresponding pivotal engagement element of the platform such that in use when said pivotal engagement element of the platform is engaged with and supported on the pivotal engagement element of the first support the platform is able to pivot relative to the first support when the height of the second end is varied while holding and retaining the platform on the support. In particular the platform is longitudinally fixed relative to the support. The platform is also preferably transversely fixed relative to the support.

The pivotal support elements of the platform and support cooperate to provide a pivot connection that allows the angle of the platform to be varied while securely retaining the platform on the support. This allows the platform to be reconfigured between a horizontal and a sloping orientation thereby increasing the variety of exercises that may be performed on the platform. The second support is referred to as being "movable". The term 'movable' means any movement or adjustment of all or part of the support that results in a change of height of the second end, and includes the second support being removed from beneath the second end, or being retained and folded or otherwise reconfigured or adapted to vary its effective height and/or the height of the second end of the platform.

The platform may be elongate having a longitudinal axis defined along its length. The corresponding pivotal engagement elements of the support and the platform are arranged to define a pivot axis extending transversely with respect to the longitudinal axis of the platform. The platform and support are arranged such that the platform is able to pivot about the pivot axis between a horizontal orientation and an orientation in which it slopes downwardly away from the support. The ends of the platform preferably include support feet to securely support the distal end of the platform remote from the pivot when that end of the platform is angled downwardly and supported directly on the ground.

The pivotal engagement elements of the first support and platform may be configured to releasably engage with each other such that the first support is detachable from the platform. The second support is also preferably detachable from the platform. In this way the platform may supported on its base directly on the ground with both the first and second supports detached and removed; in a sloped arrangement with the first end pivotally supported by the first support; or supported horizontally at a raised height with both the first and second supports supporting the first and second ends respectively. This provides at least three different in-use configurations for the platform.

The pivotal engagement element of the first support comprises one of a spindle and a seat for the spindle, and the pivotal engagement element of the platform comprises the other of a spindle and a seat for the spindle. The term "spindle" means any rod, pin, shaft or similar element functioning as an axis that rotates on another element or on which another element rotates. The term "seat" means any element capable of supporting the spindle such that it is able to rotate or is capable of rotating when supported on the spindle. Preferably the spindle is a cylindrical rod or shaft.

The spindle and seat are preferably configured for releasable engagement. Releasable engagement comprises the element being at least longitudinally fixed relative to each other but without any fixing, attachment, securement or locking element, and the such that the spindle is able to be lifted away from or out of the seat without the requirement to release or remove and other element. In this way the platform and the supports may be quickly and easily decoupled by simply lifting the platform off the support and removing the spindle from the seat. The spindle and the seat may be provided with an interference fit to provide a small of degree positive engagement and prevent rattle in use, but with the fit being designed to allow the spindle to be prised from the seat with minimal effort.

The pivotal engagement element of the platform may comprise a spindle and the pivotal engagement element of the support comprises a seat configured to receive and support the spindle. Preferably the platform includes an upper deck comprising the support surface of the platform and side walls extending downwardly from the upper deck defining a void beneath the upper deck, and wherein a pair of spindles of the platform extend inwardly into the void from the inner surfaces of the side walls at longitudinally and vertically aligned locations defining a pivot axis. Also preferably the upper part of the support is configured to be received within the void beneath the platform and a pair of spindle seats of the support are formed in the support and arranged to receive the spindles when the upper part of the support is received in the void. As such, as the platform is located over the support the spindles are received into the spindle seats.

Each spindle seat may comprise a vertically arranged channel or slot including side walls, with the channel being outwardly open along its length and upper end, the open end defining a mouth, such that the corresponding spindle is able to be received from above through the upper end and move downwardly along the channel. Further preferably the base of the channel forms a saddle for rotationally seating the spindle. The saddle is preferably u-shaped having a radius at its base corresponding to the radius of the spindle. As such, the spindles slot simply into the channels as the platform is lowered over the supports. The support preferably includes side walls and the slots are arranged at the outer surfaces of the side walls on opposing sides of the support and may be integrally formed therein.

The spindles are preferably substantially cylindrical having an outer wall and a hollow core. The spindles are diametrically compressible, and the channels of the spindle seats are configured to cause diametric compression of the spindles on insertion into the channel. Preferably each spindle includes a longitudinally extending slot or channel arranged along its upper edge, with the spindle being substantially c-shaped in cross section. This gap permits flexing of the spindle by closing at least partially during compression, thereby allowing radial compression of the spindle.

Reinforcement elements may be provided that extend upwardly from the spindles arranged to prevent the spindles from flexing upwardly while still permitting rotation of the spindles within the seating elements. Preferably the reinforcement walls secure to the spindles internally and extend upwardly out of the spindle through the compression gap.

The first and second supports preferably both include pivotal engagement elements and the platform includes pivotal support elements at the first and second ends configured to pivotally and detachably engage with the first and second supports. The first and second supports are preferably common, universal supports having the same shape and configuration. The pivotal supports at either end of the platform are also identical to each other and either support may attach to either end of the platform. In this way the first and second supports are interchangeable and a user need not be concerned which support is located at which end.

The supports are stackable to enable the height of the platform to be selectively varied at the first and second ends of the platform by adding or removing supports. Preferably the riser supports are nestable, meaning that at least part of the lower support locates within at least part of the support above it. This nesting arrangement provides secure stacking, with the side walls of the upper support laterally retaining the lower support, and vice versa. The end shape of the platform corresponds to the shape of the supports such that the supports nest in the ends of the platform in the same manner as they nest within each other.

The supports preferably include an upper surface and side walls defining a void beneath the upper surface. The supports also include spindles extending from their inner walls into the void, the spindles being configured and arranged to be received within the spindle seats of the further support nested beneath it within the void in the same manner as the platform seats on the supports. Preferably four spindles extend inwardly, spaced 90 degrees from each other, such that each support is supported on four points of contact on the support below for optimum stability. In this way the same spindle and saddle arrangement may be used to seat the platform on the supports and the supports on each other. The upper surface of each support is configured to function as a deck to receive a user during exercise so that the support may be used independently as a step or in conjunction with the platform as a satellite step.

The supports preferably include multiple sets of spindle supports arranged in corresponding pairs about their outer edge, the pairs being arranged on opposing sides of the supports to each other. This advantageously enables the supports to engage with the platform at multiple rotational positions, thereby limiting any adjustment required of the user to orientate the support to receive the platform. Preferably the supports have an octagonal shape, which provides four pairs of sides, the upper edges of which are arranged parallel to each other. This enables the pairs of sides to each be substantially identical and for any of the pairs of sides to align with the side walls of the platform. This also enables the supports, when used independently as steps, to be approached by the user from multiple directions. A spindle seat slot is provided in each of the side walls of the support.

The deck of the platform preferably includes a lower surface located within the void, and the lower surface includes recessed regions longitudinally inwards of the pivot axes at the first and second ends configured to receive the upper part of a support when the platform pivots downwardly about that end. The upper end of the supports are preferably configured to nest within the void beneath a vertically adjacent support.

The walls of the supports taper inwardly towards the upper surface such that supports are narrower at the upper end than their lower end. This tapered configuration facilitates nesting of the supports. Similarly the walls of the platform taper inwardly to the deck. The walls of the platform slope at the same angle as the walls of the support risers such the risers nest within the platform in a similar manner.

The platform preferably includes a pair of spindles extending inwardly from opposing end walls. Each end spindle is configured to be received in an adjacent spindle seat of the support when the side wall spindles are received within corresponding spindle slots of the same support. These additional end spindles provide additional support at either end of the platform when the platform is in the horizontal orientation.

In another aspect of the invention there is provided an exercise apparatus comprising a platform for supporting a person during exercise and first and second supports. The first support is arranged to support a first end of the platform at an elevated position; and the second support is arranged to engage with the platform at a second end to support the second end of the platform at an elevated position, at least the second support being removable to vary the height of the second end. At least the second support includes an upper planar surface defining a support platform onto which a user may step during exercise. At least the second support therefore has a dual function and provides a secondary exercise step that may be used in addition or alternatively to the main platform.

Preferably at least the second support includes a support platform and a wall extending downwardly from the platform that supports the platform at an elevated height above the ground. The wall is any structure that is provided beneath the platform to support it. Preferably all risers are substantially identical and have a universal form and function. As such, some risers may be used to support the main platform while others are used as secondary steps that may be selectively added to or removed from the platform at any time to vary the height and/or orientation of the platform. The risers preferably have the form and function described above in relation to the first aspect of the invention.

BRIEF DESCRIPTION OF THE DRAWINGS

Various features and advantages of the present invention may be more readily understood with reference to the following detailed description taken in conjunction with the accompanying drawings, wherein like reference numerals designate like structural elements, and in which.

DETAILED DESCRIPTION OF PREFERRED EMBODIMENTS

Figure 1:
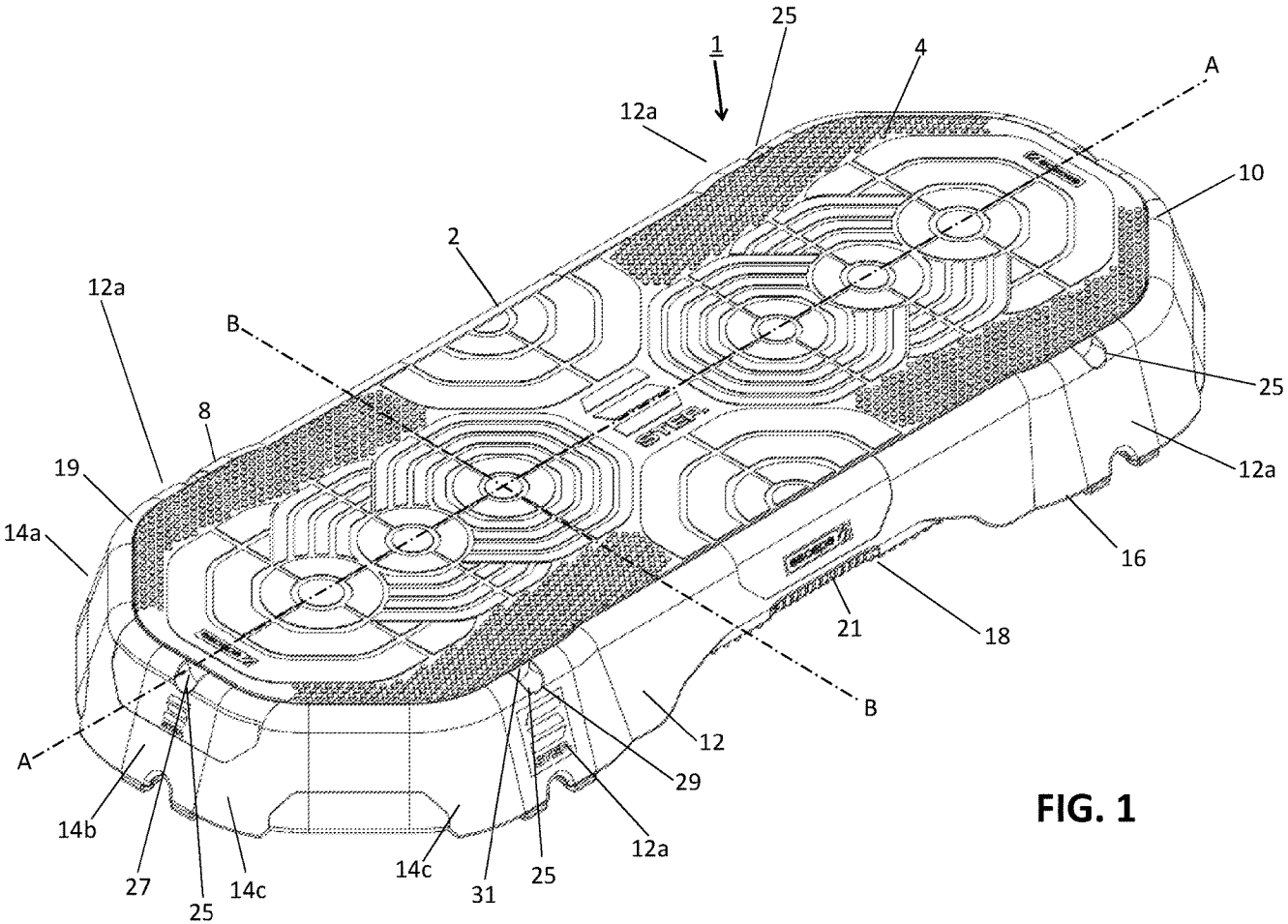
FIG. 1 shows an exercise step according to an embodiment of the invention.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

Referring to FIG. 1, an exercise step 1 comprises a platform 2 having a planar upper deck 4, the surface of which is configured to be stepped or jumped upon by a person during exercise. The platform 2 is elongate having a length defining a longitudinal axis A-A. A transverse axis B-B extends perpendicular to the longitudinal axis. The deck 4 includes an inlay mat 8 formed from a resilient material such as polyurethane or rubber. The inlay 8 seats in a recess formed in the deck 4 and is surrounded by a raised lip 10 that helps retain the inlay 8 in position. The inlay 8 is bonded to the upper surface of the deck 4 and includes an array of textured surface features 11 molded into the surface. The combination of the resilient material and the molded surface features enhances the grip of the surface of the deck 4 and provides a degree of cushioning. Alternatively, the textured grip surface may be molded directly into the upper surface of the deck 4.

The platform 2 is molded from a rigid plastic material such as polypropylene. Side walls 12 and end walls 14 are integrally molded and extend downwardly from the deck 4 about its periphery. The ends of the platform 2 include three edges angled to each other, with the endmost edge being perpendicular to the side walls. Each of the angled sections of the end walls 14 are of the same length such that ends of the platform have a substantially semi-octagonal shape in combination with the side walls 12. The side walls 12 and end walls 14 slope outwardly in a downward direction away from the deck 4. As a result the footprint of the platform 2 at its base 16 is greater than the footprint area of the deck 4. A scalloped cut-away section 18 is provided along the lower edge 16 of each side wall 12 which enables a user to fit their hands under the platform 2 when it is placed directly on the ground to lift the platform 2.

The deck 4 has an elongate octagonal shape extended by the side walls 12. The end walls 14 include three wall sections 14*a-c* angled at 135 degrees to each other and to the end sections 12*a* of the side walls 12. A curved edge 19 extends around the periphery of the deck 4 providing a transition between the deck 4 and the walls 12 and 14. The curved edge 19 avoids sharp corners that cause injury on impact. The end sections 12*a* of the side walls 12 and the end walls 14*b* each include arched apertures 23 at the base of each wall. The arches 23 allow a flexible band, cable, or other cord element to be passed beneath the platform 2 when it is supported directly on the floor, with the cable being anchored by the platform 2. The arches 23 also provide recesses to enable a user to hook their fingers underneath the platform 2 for lifting.

A series of support slots 25 of a platform pivotal engagement element are provided at the upper edge of each end wall section 14*b* and the upper edge of the end sections of the side walls 12*a*. Each support slot 25 extends through the curved edge 19 downwardly into the corresponding wall. The support slots 25 each include side walls 27 and a base 29. The slots 25 are open at their upper end and are closed lengthwise along their inner edge by an inner rear wall 31. The base 29 is concave defining a curved seat at the base of the support slot 25. Each support slot 25 is arranged centrally at the middle of the upper edge of wall sections and diametrically opposite the support slot 25 of the opposing wall sections. The support slots 25 are therefore arranged at regular angular intervals of 45 degrees around the peripheral edge of the deck 4.

Figure 2:
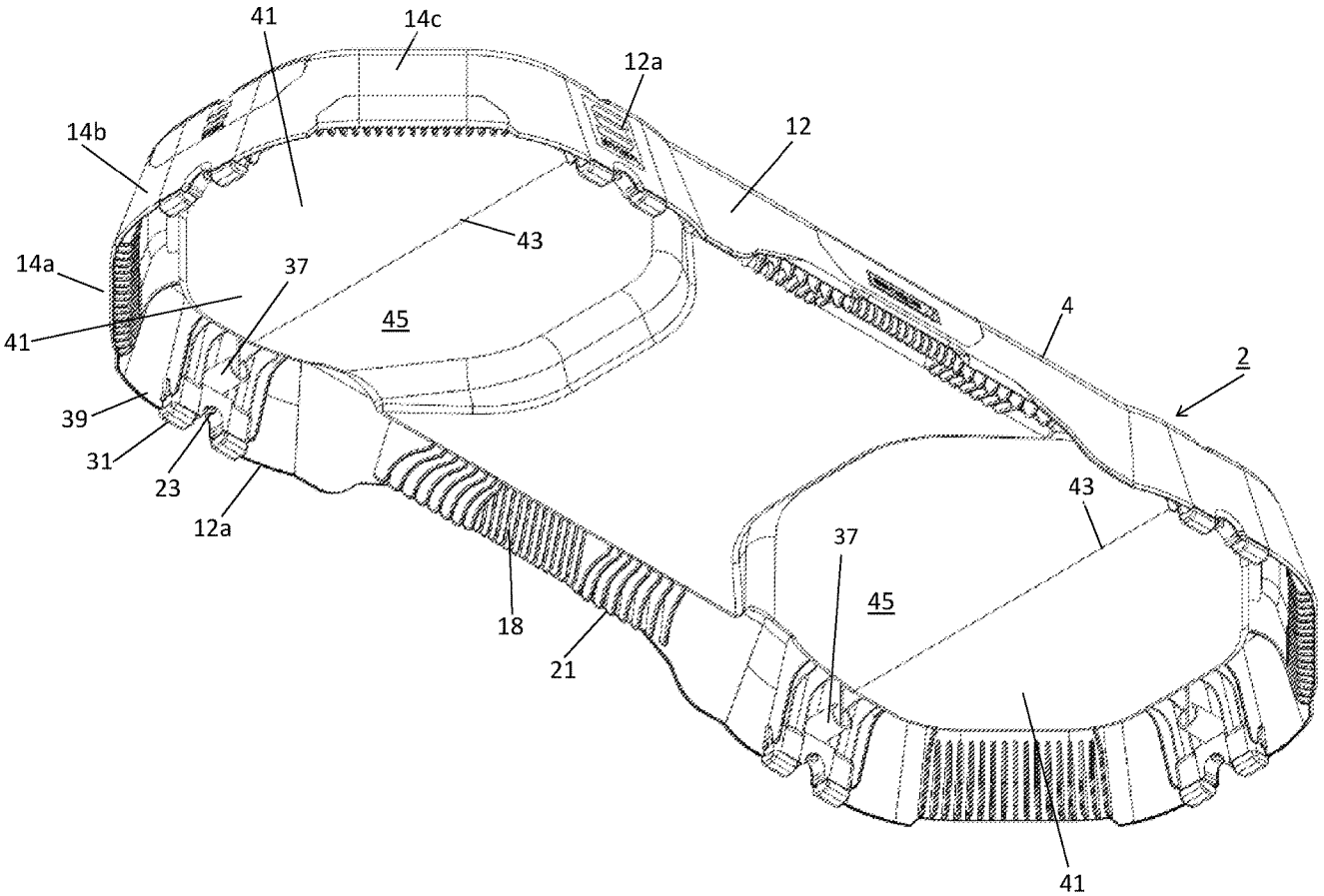
FIG. 2 shows the platform of FIG. 1 from beneath.

As shown in FIG. 2, the side walls 12 and end walls 14 have a substantially constant thickness, and in combination with the deck 4 define a hollow void within the platform 2 beneath the deck 4. Reinforcing ribs 21 extend upwardly from the edge of the recessed scalloped section 18 to the lower surface of the deck 4 on the inner surface of the side walls 14. The lower ends of the ribs 21 have curved edges to provide a grip region for a user's fingers.

As the walls 12 and 14 of the platform 2 taper outwardly away from the deck 4, and define a hollow void within the platform 2, the platform 2 is nestable within another platform for storage or transport.

The platform 2 includes a plurality of support inserts 31 arranged internally. The support inserts 31 are secured on the inner surfaces of the end sections 12*a* of the side walls 12 and the end walls 14*b*. However, the inserts 31 could also be inserted on the inner surfaces of the other end walls 14*a* and 14*c* in an alternative arrangement. Each support insert 31 includes a body 33 that is secured to the corresponding inner wall by a first screw at the saddle of the arch 23 and by secondary screws which extend into molded bosses extending from the lower edge of the deck 4.

A cylindrical support spindle 37 of the platform pivotal engagement element extends inwardly from each support insert 31. The spindles 37 extend into the void of the platform 2 parallel to the plane of the deck 4 in a diametric direction. The spindles 37 are hollow cylindrical tubes having an open channel along their upper edges through which a reinforcing wall 39 extends and connects to the deck 4. The spindles 37 are aligned with the support slots 25 located above them such that when a further platform is located beneath, the spindles 37 align with the support slots 25 of that platform.

The lower surface of the deck 4 includes end sections 41 having a lower surface substantially parallel with the upper surface of the deck 4. The inner edges 43 of the end sections 41 are axially aligned with the spindles 37 extending from the end sections 12*a* of the side wall 12. The end sections 41 are substantially semi hexagonal in shape. Recessed sections 45 extends from the inner edges 43 and are also semi hexagonal in shape. At the recessed sections 45 the lower surface of the deck 4 slopes upwardly at a constant angle towards the upper surface of the deck providing a region in which the height gradually increases in the longitudinal direction. At the inner edge of the recessed sections 45 the height returns to the same depth as the end sections 41, with an inner wall 47 having the same profile and taper as the end wall 14

Figure 3:
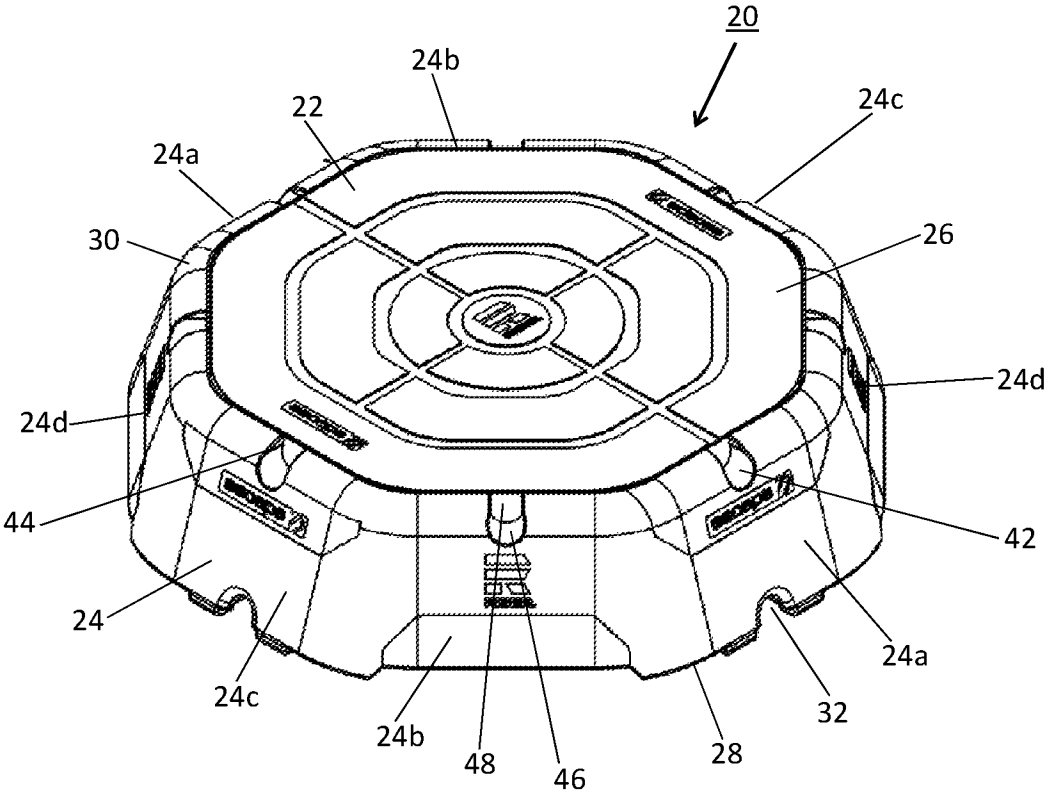
FIG. 3 shows a riser support according an embodiment of the invention.
Figure 4:
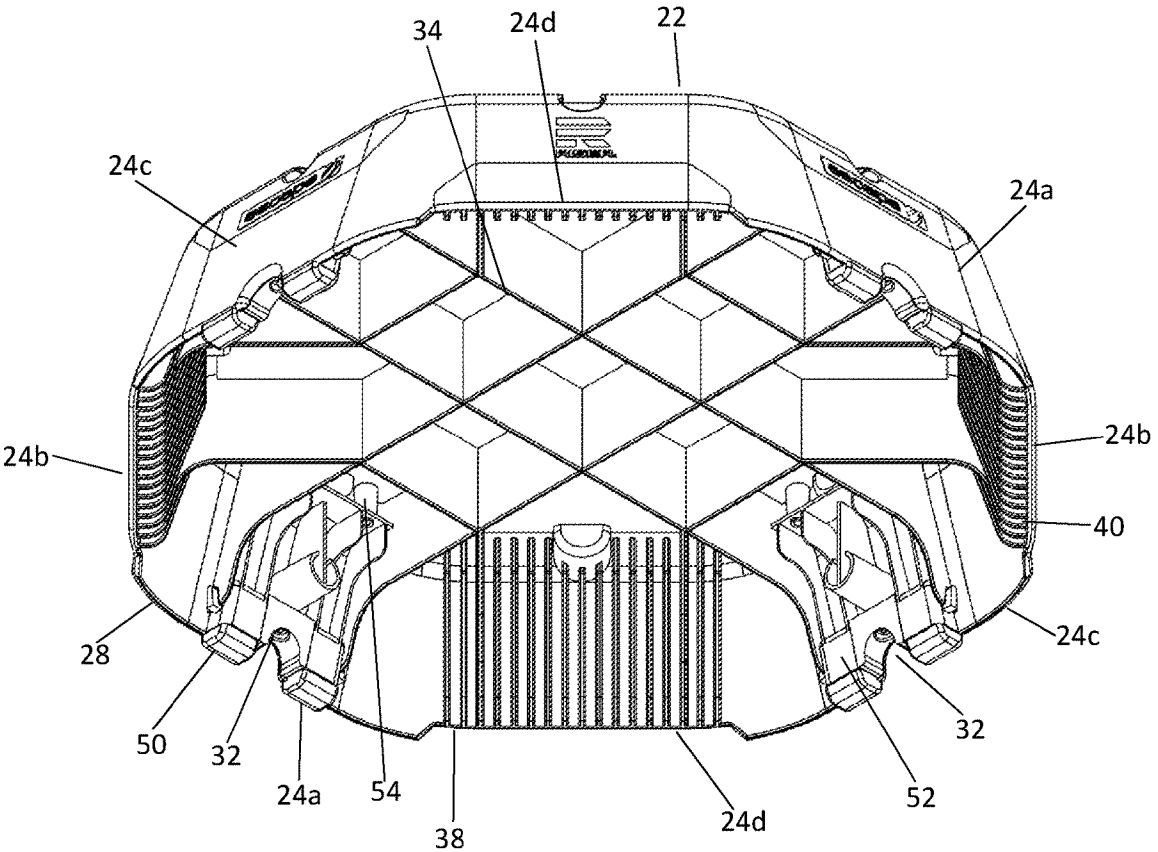
FIG. 4 shows the riser support of FIG. 2 from beneath.

FIG. 3 shows a support 20 used to raise the height of the platform 2. Supports (or risers) 20 are provided beneath the platform 2 at either end to raise the height of the platform 2 by functioning as feet, supporting the platform 2 while also providing additional height extending the vertical position of the deck to a height greater than the depth of the walls 14 and 16 of the platform. The support 20 can be arranged to support a first end 41 of the platform 2 at an elevated position. The support 20 comprises a support pivotal engagement element 42/56 configured for cooperative engagement with the platform pivotal engagement element 25/37 at the first end of the platform such that in use, when the platform pivotal engagement element at the first end of the platform is cooperatively engaged with the support pivotal engagement element, the first end of the platform is able to pivot relative to the first support.

Each risers 20 includes an upper deck 22 and integrally molded side walls 24. The deck 22 has an octagonal shape and includes an inlay mat 26 formed from a resilient material in the same manner as the deck 4 of the platform 2. The side walls 24 taper outwardly towards the base 28 such that the footprint of the base 28 is greater than that of the deck 22. The walls taper outwardly at the same angle as the walls of the platform 2. The riser 20 is shaped to be nestably received beneath the platform 2 at the ends of the platform.

The deck 22 is substantially octagonal in shape and as such there are eight corresponding side walls 24. A curved edge 30 at the periphery of the deck 22 provides a transition between the deck and the side walls 24. The curved edge 30 avoids sharp corners that cause injury on impact. The walls 24, being eight in number, are arranged in opposing pairs 24*a-d*. Two pairs of side walls 24*a* and 24*c* include arched apertures at the base 28 of each wall 24*a* and *c*. The arches 32 allow a flexible band, cable, or other cord element to be passed beneath the riser 20 and anchored by the riser 20. The arches 32 also provide recesses to enable a user to hook their fingers underneath the riser for lifting.

Support slots 42 of the support pivotal engagement element are provided at the upper edge of each wall 24 having the same shape and configuration as the support slots 25 of the platform. Each support slot 42 extends through the curved edge 30 downwardly into the corresponding wall 24. The support slots 42 each include a side wall 44 and a base 46. The slots 42 are open at their upper end and are closed lengthwise along their inner edge by an inner rear wall 48. The base 46 is concave defining a curved seat at the base of the support slot 42. Each support slot 42 is arranged centrally at the middle of the upper edge of each wall 24 and diametrically opposite the support slot 42 of the opposing wall 24. The support slots 42 are therefore arranged at regular angular intervals of 45 degrees around the peripheral edge of the deck 22. The arrangement of the slots 42 is such that when the riser is nested within the end of the platform 2, the slots 42 of the riser 20 are aligned with the slots 25 of the platform at respective walls.

The walls 24 of the risers 20 have a substantially constant thickness, which in combination with the deck 22 define a hollow void within the riser 20 beneath the deck 22. A series of reinforcing walls 34 extend between the inner surfaces of the walls 24 laterally, with each wall 34 spanning between opposing pairs of side walls 24 and also engaging at its upper edge the lower surface of the deck 22. The walls 34 thereby laterally reinforce the side walls 22 and support the deck 22. Both pairs of side walls 24*b* and 24*d* include elongate recesses 38 at their lower edge 28. The elongate recesses 38 allow a user to extend fingers or a flattened palm beneath the riser for lifting. Reinforcing ribs 40 extend upwardly from the edge of the recesses 38 to the lower surface of the deck 22 on the inner surface of the walls 24*b* and 24*d*. The lower ends of the ribs 40 have curved edges to provide a grip region for a user's fingers.

The walls 24 of the riser 20 taper outwardly away from the deck 22, and define a hollow void within the riser 20. The risers 20 are nestable within each other.

The risers 20 include support inserts 50 which are identical to the support inserts of the platform. This is advantageous as it enables a universal insert to be manufactured that may be installed to both the platform and riser. The support inserts 50 are secured on the inner surfaces of the wall 24*a* and 24*c*. However, the inserts 50 could be inserted on the inner surfaces of every wall 24 around the riser 20 in an alternative arrangement. Each support insert 50 includes a body 52 that is secured to the inner wall 24 by a first screw at the saddle of the arch 32 and by secondary screws which extend into molded bosses 54 extending from the lower edge of the deck 22. The inserts 50, 31 are easily removable by removing the screws. This enables the inserts to be replaced in the event of damage or excessive wear, thereby increasing the overall life of the platform.

Cylindrical support spindles 56 of the support pivotal engagement element extend inwardly into the void of the riser 20 parallel to the plane of the deck 22 in a transverse diametric direction. The spindles 56 are aligned with the support slots 42 and are shaped and dimensioned to be received within the support slots of a riser 20 nested beneath.

Figure 5:
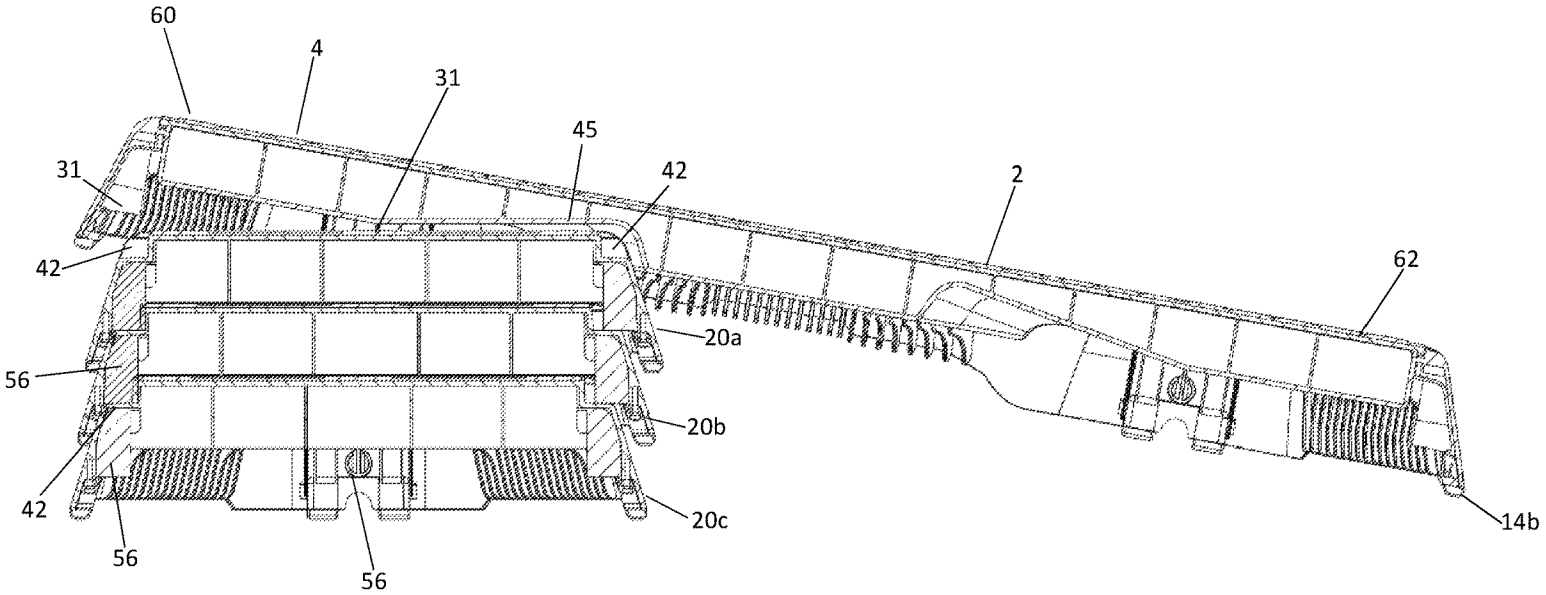
FIG. 5 shows a section view of a stacked and inclined platform and riser arrangement according to an embodiment of the invention.
Figure 6:
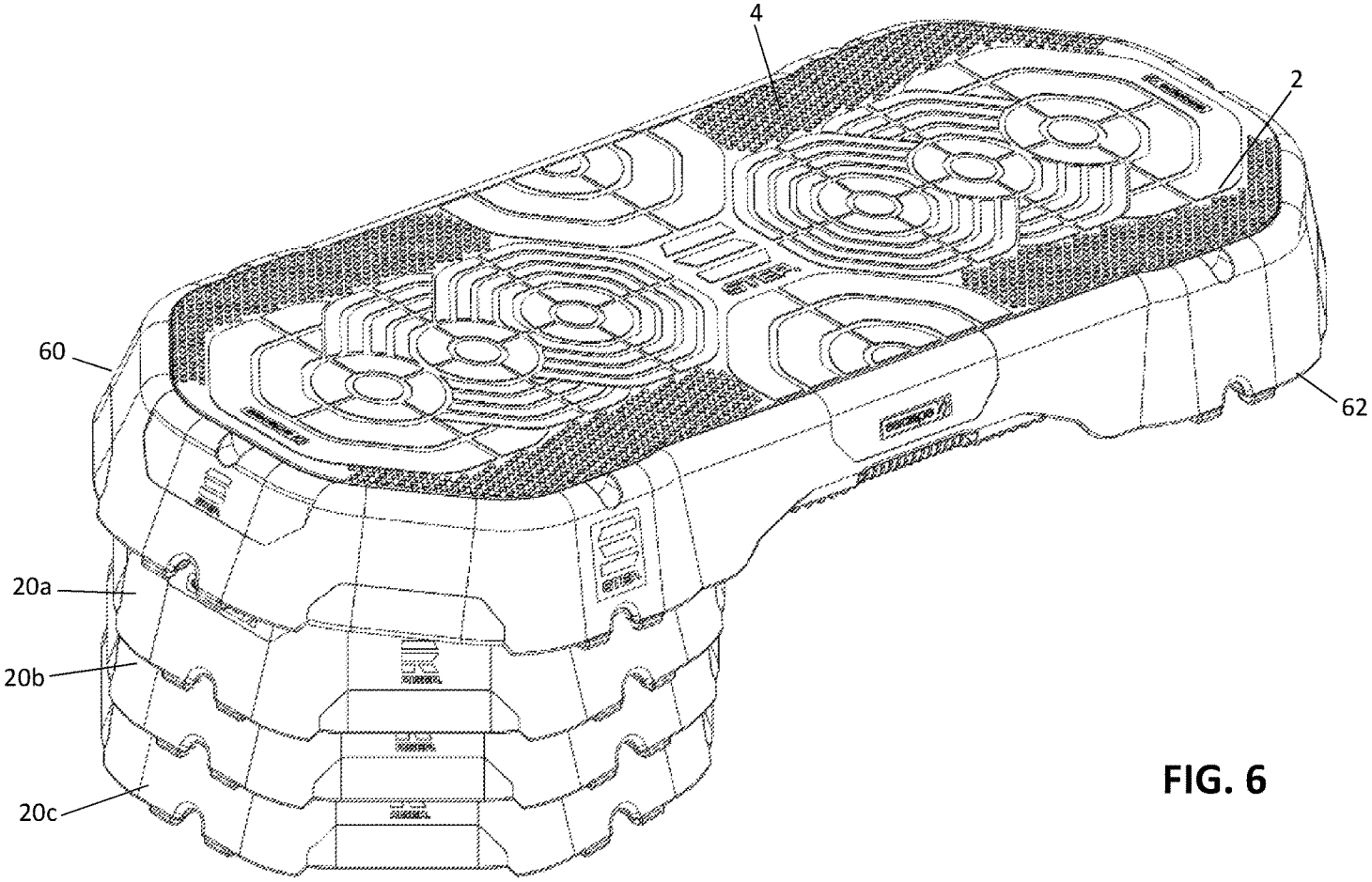
FIG. 6 is an isometric view of the arrangement of FIG. 5.

As shown in FIG. 5, the spindles 56 seat into the slots 42 when the risers 20 are nestably stacked. In the same way, the spindles 31 of the platform 2 seat and locate into the riser nested immediately beneath the platform 2. In the arrangement shown in FIG. 5 the spindles 31 are located in the side walls 12*a* of the platform 2 at a first end 60 and seated in support slots 42 on opposing sides of the top riser 20*a*. Further risers 20*b* and 20*c* are nested beneath the top riser 20*a* to increase the height further. The four spindles 56 of riser 20*a* seat into the slots 42 of the walls 24 immediately beneath them. Similarly with the spindles of riser 20*b* and the slots 42 of riser 20*c*.

In this arrangement no risers 20 are provided beneath the second end 62 of the platform 2. As such the end wall 14*b* of the second end 62 is at ground level, placing the platform at an angle. The cylindrical shape of the spindles 31, 56 and the curved saddle of the slots 25, 42 are such that the saddles have substantially the same radius as the spindles such that when the spindles are seated in the saddles they are able to rotate about their longitudinal axis within the slots while still being supported on the saddle. In this way, the spindles 31 of the first end 60 of the platform are able to rotate within the corresponding slots 42 of the riser 20*a* to allow the platform 2 to incline. The recess 45 in the lower surface of the platform 2 accommodates the inner end of the deck of the riser 20*a* as the second end 62 of the platform 2 inclines downwardly. The angle and depth of the recess 45 is selected to define a maximum height to the riser stack above which the spindles 31 platform 2 may no longer be inserted into the slots 42 of the top riser 20*a*. This provides a built in safety measure that prevents the platform from securing to the risers if they are stacked above a safe and stable height. A non-sectioned view is also provided for illustrative purposes.

To avoid rattle and accidental release of the spindles 31, 56 from slots 25, 42, the width of the slots 25, 42 is selected to provide a locking 'interference' or 'tight tolerance' fit with the spindles requiring a significant positive pressure to force the spindles into the slots. This fit ensures the spindles are held tightly within the slots while still being able to rotate. The fit is also selected to allow the spindles to be removed from the slots without undue effort. The arches and cutaways along the lower edges of the platform 2 and risers 20 allow a user to apply a secure grip for prising the platform 2 and risers 20 apart. The arches also allow a user to extend a flexible cable such as a resistance band beneath the platform, with the platform anchoring the band. Preferably the slots 25, 42 are shaped to taper inwardly very slightly towards the mouth of the slots with the interference or tolerance fit being provides at the entrance to the slots 25, 42 while the base of each slot is slightly wider to allow a more free rotation of the spindles. In one embodiment, two pairs of slots 42 of the risers arranged at 90 degrees to each other may be provided with the locking fit, while the other two pairs have a wider 'unlocked' fit. This allows the risers 20 to be stacked in an unlocked state for storage, allowing them to be more easily unstacked for use, while being used in the locked state for better security. Alternatively the locked positions may be selected if it is desired to store or transport the deck and risers in an assembled connected arrangement. The respective slots may be marked with indicia to indicate the locked and unlocked positions.

The deck 22 provides a continuous planar support surface extending across the upper surface of the riser 20. The platform 2 is supported at the outer edges of the riser 20 by the spindles 56 that are received within the corresponding slots 42. In the embodiments of the prior art, risers typically have a hollow square form defined by outer walls. A deck is not provided as it unnecessary to enable the riser to support the platform and in line with conventional manufacturing practice the omission of material in the centre of the riser, and in particular the omission of an upper surface or 'deck', reduces material usage and minimizes weight. The applicant has identified that yet further broadening of the functionality of the platform may be provided by including a deck 22 on the risers 20. The deck 22 enables the risers 20 to be used independently as discrete exercise steps in addition to or as an alternative to the platform 2. For example, an exercise routine may be designed that requires the user to alternate between stepping onto the platform set at a first height, and onto a riser set at different height. Alternatively, for certain classes where step exercise forms only a small part of the routine, or where transport space is limited for an instructor, the risers 20 may be used on their own in a class.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. An exercise apparatus comprising:

a platform for supporting a person during exercise, the platform having a first end and a second end; and a first support arranged to support the first end of the platform at an elevated position;

wherein the first support comprises a first support pivotal engagement element configured for cooperative engagement with a platform pivotal engagement element at the first end of the platform such that in use, when the platform pivotal engagement element at the first end of the platform is cooperatively engaged with the first support pivotal engagement element, the first end of the platform is able to pivot relative to the first support; and wherein the first support is detachable from the platform.

2. The exercise apparatus according to claim 1, wherein the platform is elongate having a longitudinal axis defined along its length and the cooperative first support and platform pivotal engagement elements are arranged to define a pivot axis extending transverse to the longitudinal axis of the platform, the platform and first support being arranged such that the platform is able to pivot about the pivot axis between a horizontal orientation and an orientation in which it slopes downwardly away from the first support.

3. The exercise device according to claim 1, wherein the first support pivotal engagement element comprises one of a spindle and a seat for the spindle, and the platform pivotal engagement element comprises the other of a spindle and a seat for the spindle.

4. The exercise apparatus according to claim 3, wherein the platform pivotal engagement element comprises the spindle and the first support pivotal engagement element comprises the seat for the spindle.

5. The exercise apparatus according to claim 1 further comprising a second support arranged to support the second end of the platform at an elevated position;

wherein the second support comprises a second support pivotal engagement element configured for cooperative engagement with a platform pivotal engagement element at the second end of the platform; and wherein the second support is detachable from the platform.

6. The exercise apparatus according to claim 5, wherein the shape and configuration of the first and second supports are such that the first and second supports are interchangeable.

7. The exercise apparatus according to claim 6, wherein the supports are stackable to enable the height of the platform to be selectively varied at the first and second ends of the platform by adding or removing supports.

8. The exercise apparatus according to claim 7, wherein the supports are nestable.

9. The exercise apparatus according to claim 8, where each support includes an upper surface and side walls defining a void beneath the upper surface, and the supports include spindles extending from inner walls into the void, the spindles being configured and arranged to be received within the spindle seats of a further support nested beneath it within the void.

10. The exercise apparatus according to claim 9, wherein the supports include multiple sets of spindle seats arranged about an outer edge to enable the supports to engage with the platform or another support at multiple rotational positions.

11. The exercise apparatus according to claim 1, wherein the first support includes side walls and channels arranged at outer surfaces of the side walls on opposing sides of the first support.

12. The exercise apparatus according to claim 1, wherein a deck of the platform includes a lower surface that includes recessed regions located longitudinally inwards of pivot axes at the first and second ends.

13. The exercise apparatus according to claim 1, wherein the platform includes an upper deck comprising a support surface of the platform and side walls extending downwardly from the upper deck defining a void beneath the upper deck;

wherein the first end of the platform comprises a pair of platform support pivotal engagement elements;

wherein the first support comprises a pair of first support pivotal engagement elements;

wherein each of the platform pivotal engagement elements comprise a spindle and each of the first support pivotal engagement elements comprise a seat for the spindle; and wherein the spindles extend inwardly into the void from inner surfaces of the side walls at longitudinally aligned locations defining a pivot axis and at least part of the first support is configured to be received within the void beneath the platform and the seats for the spindles of the first support are arranged to receive the spindles when the part of the first support is received in the void.

14. The exercise apparatus according to claim 13, wherein each spindle seat comprises a vertically arranged channel open along its length from a base to an upper end such that the corresponding spindle is able to be received through the upper end and move downwardly along the channel, and the base of the channel forms a curved saddle for rotationally seating the spindle.

15. The exercise apparatus according to claim 14, wherein the spindles are substantially cylindrical and diametrically compressible, the channel of each spindle seat being configured to cause diametric compression of the spindles on insertion into the channel.

* * * * *